US005450772A

United States Patent [19]

Barone et al.

[11] Patent Number: 5,450,772

[45] Date of Patent: Sep. 19, 1995

[54] VALVE LIFTER ADJUSTOR TOOL

[76] Inventors: Larry A. Barone, P.O. Box 1729, Sedona, Ariz. 86336; John L. Powers, Sr., 2201 N. 37th Pl., Phoenix, Ariz. 85008

[21] Appl. No.: 84,799

[22] Filed: Jun. 29, 1993

Related U.S. Application Data

[63] Continuation-in-part of Ser. No. 783,383, Oct. 28, 1991, abandoned.

[51] Int. Cl.[6] ..... B25B 13/48

[52] U.S. Cl. ..... 81/9.24; 7/164; 33/611; 81/121.1

[58] Field of Search ..... 81/9.24, 121.1; 33/600, 33/607, 611, 645; 7/100, 164

[56] References Cited

U.S. PATENT DOCUMENTS

| | | | |
|---|---|---|---|
| 3,811,194 | 5/1974 | Swift | 33/611 |
| 4,817,475 | 4/1989 | Kelly et al. | 81/121.1 |
| 4,993,289 | 2/1991 | Parks | 81/121.1 X |
| 5,077,909 | 1/1992 | Cranor | 33/607 |

*Primary Examiner*—D. S. Meislin

[57] ABSTRACT

An engine is provided with hydraulic valve lifters and other valve train components, wherein the invention consists of a tool which utilizes the engines existing valve train components to determine if the correct adjustment is present to provide for the proper clearances of the hydraulic valve lifters. Several embodiments are disclosed, including gauge only embodiments and embodiments which include adjusting and gauging functions.

17 Claims, 2 Drawing Sheets

VALVE LIFTER ADJUSTOR TOOL

CROSS REFERENCE TO RELATED APPLICATION

This application is a Continuation in Part application of Ser. No. 07/783,383, filed Oct. 28, 1991, now abandoned.

BACKGROUND OF THE INVENTION

1. Field of the Invention

The field of invention relates to engines, and more particularly pertains to a new and improved method of gauging and adjustment of the valve train components in order to achieve correct hydraulic valve lifter clearance. The tool provides for visual indication, as well as proper visual instruction as to achieving the correct adjustment of valve train components in order to obtain correct hydraulic valve lifter clearance.

2. Description of the Prior Art

While various tools and components have been utilized in the prior art of achieving the proper adjustment of the valve train components in order to obtain correct clearance for the valve lifter, they have proven awkward in procedure and have not communicated when the correct clearances are instantly achieved.

Prior state of the art tools require that they be manually pre-set by the operator to the correct dimension required before valve train adjustment can begin, or the necessity to manipulate the engine by rotating its internal components in order to achieve the "zero lash" position, for each cylinder, prior to performing the necessary adjustments to achieve correct valve lifter clearance. For these tools this requires additional procedures for the operator and provides for incorrect adjustment of the valve train components in the event that the pre-set adjustment be done incorrectly, the pre-set adjustment should inadvertently change during use, or that the "zero lash" position be incorrectly established.

To achieve correct hydraulic valve lifter clearance the instant invention overcomes the deficiencies of the prior art by providing proper visual indications as well as proper visual instruction while performing adjustment to the valve train components and does not require the operator to manually pre-set the tool or determine the "zero lash" position of the valve train components.

As such, it may be appreciated that there continues to be a need for a new and improved method to achieve correct hydraulic valve lifter clearance as set forth by the instant invention which addresses both the problems of ease of use as well as effectiveness in expensive construction and in this respect, the instant invention substantially fulfills this need.

SUMMARY OF THE INVENTION

The present invention provides a valve lifter adjustor tool which utilizes visual indication for gauging and visual observation or instruction during adjustment to provide the proper clearance of valve lifters when used in conjunction with an engine's existing valve train components. As such, the general purpose of the present invention, which will be described subsequently in greater detail, is to provide a new and improved valve lifter adjustor tool which has all the advantages of the prior art and none of the disadvantages.

The engines existing valve train adjusting components consist of varying sizes of components such as rocker arm studs, rocker arm nuts, rocker arms and rocker arm ball seats. The instant invention includes a cylindrical member of a required configuration to utilize the existing valve train adjusting components. One embodiment includes viewing slots, and two embodiments include calibrated notches and a drive housing assembly.

Two embodiments include a magnetic position indicator bar which is placed horizontally through the inventions cylinder member at a specific vertical height within the cylinder member. The cylinder member of the invention is placed onto the engines existing valve train adjusting components and will utilize visual indication, as well as proper visual instruction for adjusting the valve lifter nut. That is, the magnetic position indicator bar is visually observed while adjustment is performed with the use of a standard rachet type wrench. The precise adjustment of the engines existing valve train components to provide correct valve lifter clearance is thus accomplished.

Our invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is an object of the present invention to provide a new and improved valve lifter adjustor tool which has all the advantages of the prior art and none of the disadvantages.

It is another object of the present invention to provide a new and improved valve lifter adjustor tool which may be easily and efficiently manufactured and marketed.

It is a further object of the present invention to provide a new and improved valve lifter adjustor tool which is of a durable and reliable construction.

Another object of the present invention is to provide new and useful apparatus for visually gauging the correct adjustment of a valve lifter nut on a valve lifter stud.

Another object of the present invention is to provide new and useful valve lifter adjustor apparatus having a magnetic indicator.

Another object of the present invention is to provide new and useful valve lifter adjustor apparatus having a visual reference for adjusting a valve lifter.

DESCRIPTION OF THE PREFERRED EMBODIMENT

Figure 1:
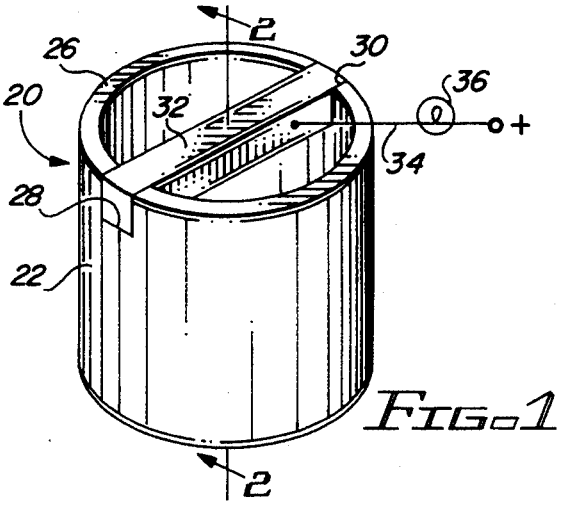
FIG. 1 is a perspective view of the apparatus of the present invention.
Figure 2:
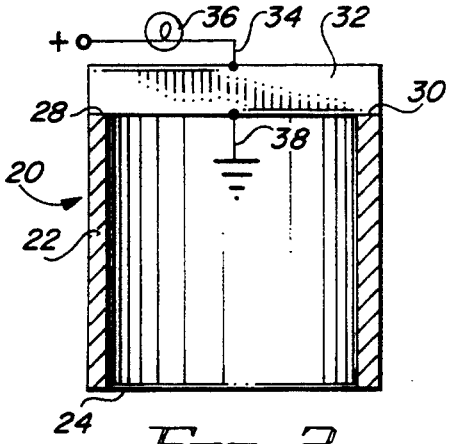
FIG. 2 is a view in partial section taken generally along line 2—2 of FIG. 1.
Figure 3:
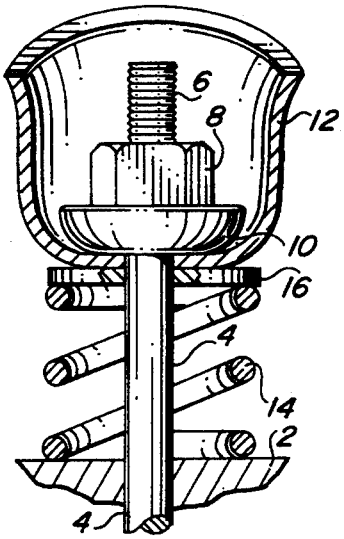
FIG. 3 is a side view in partial section illustrating the use environment of the apparatus of the present invention.

FIG. 1 is perspective view of valve lifter indicator apparatus 20 of the present invention. FIG. 2 is a view in partial section of the apparatus 20 of FIG. 1 taken generally along line 2—2 of FIG. 1. FIG. 3 is a view in partial section showing the use environment of the valve lifter indicator apparatus 20.

The use environment illustrated in FIG. 3, which is a fragmentary view in partial section, includes a portion of the top of a cylinder head of an engine 2, with a rocker arm stud 4 extending through the engine or head 2 and upwardly therefrom. The top of the stud 4 includes a threaded portion 6.

A nut 8 is disposed on the threaded portion 6, and is tightened down against a ball seat or pivot element 10. The top surface of the ball seat or pivot element 10 is generally flat, and the nut is disposed against the top flat surface. The ball seat or pivot 10 is in turn disposed within a rocker arm 12.

Beneath the rocker arm 12 is a compression spring 14. The compression spring 14 is disposed between the top of the engine 2 and a spring retainer 16. The spring retainer 16 is in turn disposed against the bottom of the rocker arm 12.

For adjusting the hydraulic valve lifter, the nut 8 is raised or lowered relative to the stud 4 on the threaded portion 6 of the stud 4 by rotating or turning the nut.

Figure 4:
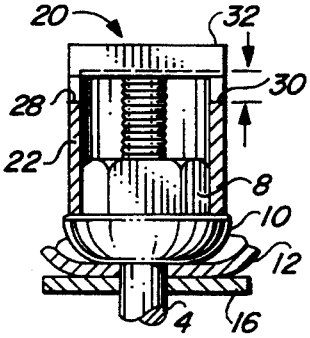
FIG. 4 is a side view in partial section illustrating the employment of the apparatus of the present invention in its use environment.
Figure 5:
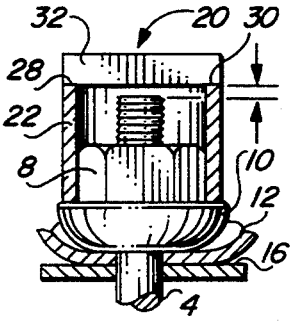
FIG. 5 is a side view in partial section also illustrating the employment of the apparatus of the present invention in its use environment.
Figure 6:
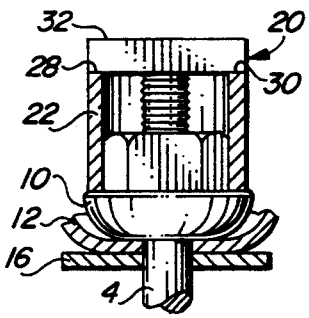
FIG. 6 is a side view in partial section also illustrating the apparatus of the present invention in its use environment.

FIG. 4 is a view in partial section illustrating the apparatus 20 disposed on the top of the ball seat or pivot 10, and FIGS. 5 and 6 are similar views. FIGS. 4, 5, and 6 illustrate the employment of the indicator apparatus 20 in three situations, too tight, too loose, and correct.

The indicator apparatus 20 is a generally cylindrical element 22 which includes a bottom surface 24 and a top surface 26. The surfaces 24 and 26 are generally parallel to each other and generally perpendicular to the longitudinal axis of the cylinder 22. The element 22 is preferably nonmagnetic.

Extending downwardly from the top surface 26 are two calibrated slots, including a slot 28 and a slot 30. The slots 28 and 30 are diametrically opposed to each other. The bottom of the slots are calibrated for a particular stud 4 when the stud 4 is correctly adjusted.

A magnetic indicator bar 32 is disposed in the slots 28 and 30.

If desired, a visual or audible signal may be incorporated into the gauge apparatus 20. The visual or audible signal elements are schematically shown in FIGS. 1 and 2. For incorporating the visual or audible elements, the cylinder 22 must be made of a dielectric material, or at least the bar 32 must be electrically isolated from the cylinder 22.

A conductor 34 is connected to the bar 32 and extends to the positive terminal of a battery, such as the automotive battery of the vehicle in which the engine 2 is disposed. A signal element 36, which may be a lamp or a buzzer, etc., is connected in the conductor 36.

When the bar 32 contacts the top of the stud 4, the electrical circuit is complete to ground and the lamp 36 illuminates or an audible signal sounds, indicating the correct height or adjustment of the nut 8 relative to the stud 4 and the rocker arm 12. The grounding or completing of the circuitry is illustrated in FIG. 2 by the ground conductor 38.

The employment of the apparatus 20 in the environment of FIG. 3 is illustrated in FIGS. 4, 5, and 6.

In FIG. 4, the indicator bar 32 is raised above the slots 28 and 30, indicating an incorrect adjustment of the nut 8. For using the signal elements 34 and 36 in the environment of FIG. 4, the lamp 36 would be on. An indication of the nearly correct adjustment of the nut would occur when the lamp turned off. That is, the breaking of the circuit would indicate the proper adjustment, or nearly so. A tweaking of the nut to just turn on the lamp could then be accomplished.

In FIG. 5, the top of the stud 4 is below the bottom of the bar 32, and the bar 32 accordingly rests easily in its slots 28 and 30, indicating that the stud is incorrectly adjusted. The lamp 36 would be off.

In FIG. 6, the top of the stud 4 is disposed at the bottom of the indicator bar 32, with the bar 32 resting in the slots 28 and 30. This indicates the correct adjustment of the nut 8 with respect to the stud 4.

It will be noted that the apparatus 20 is merely an indicator tool, and not an adjusting tool. That is, the apparatus 20 must be removed in order to adjust the nut 8 relative to the stud 4.

Figure 7:
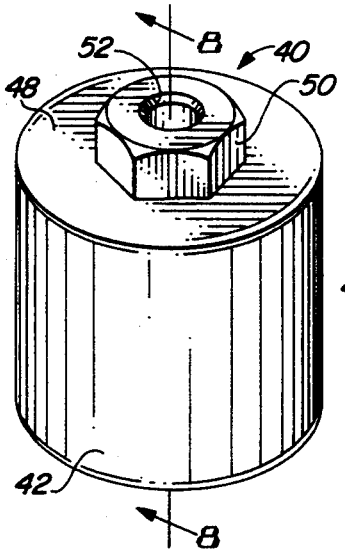
FIG. 7 is a perspective view of an alternate embodiment of the apparatus of the present invention.

An alternate embodiment of the indicator apparatus 20 is illustrated in FIG. 7, 8, 9, 10, and 11. FIG. 7 comprises a perspective view of an alternate embodiment 40 of the indicator apparatus 20 which also includes provisions for adjusting the nut. The apparatus 40 comprises a combination of indicator tool and adjusting tool.

Figure 8:
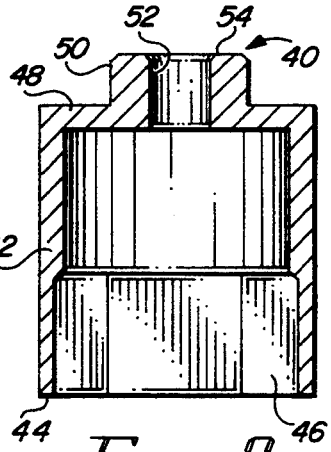
FIG. 8 is a view in partial section taken generally along line 8—8 of FIG. 7.
Figure 9:
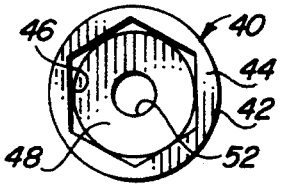
FIG. 9 is a bottom view of the apparatus of FIGS. 7 and 8.
Figure 10:
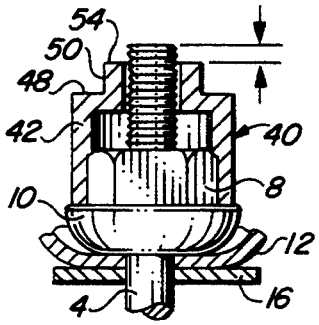
FIG. 10 is a side view in partial section illustrating the apparatus of FIGS. 7, 8, and 9.
Figure 11:
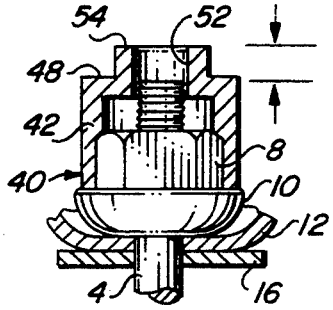
FIG. 11 is a side view in partial section illustrating the use environment of the apparatus of FIGS. 7, 8, and 9.

FIG. 8 is a view in partial section of the tool apparatus 40 taken generally along line 8—8 of FIG. 7. FIG. 9 is a bottom view of the apparatus 40. FIGS. 10 and 11 illustrate the operation of the tool 40 in its use environment. For the following discussion, reference will be made to FIGS. 7, 8, 9, 10, and 11.

The tool apparatus 40 includes a cylindrical element 42 with a bottom surface 44. Extending upwardly from the bottom 44 of the cylinder 42 is a hex portion 46. The hex portion 46 is adapted to receive the hex nut 8, as shown in FIGS. 10 and 11.

The cylinder 42 is closed by a top wall 48. Extending upwardly from the top wall 48 is an external hex drive boss 50. The outer configuration of the boss 50 is hexagonal to receive a wrench for rotating the cylinder 42 relative to a stud 4, as will be discussed below.

Extending through the external boss 50 is a clearance hole 52. The clearance hole 52 receives the rocker arm stud 4, or the top portion of the rocker arm stud 4. The boss 50 includes a top surface or face 54. When the top of the stud 4 is flush or even with the top surface 54, the nut 8 is adjusted correctly.

In FIG. 10, the top of the stud 4 extends above the top surface 54, indicating an incorrect adjustment of the nut 8. In FIG. 11, the top surface of the stud 4 is beneath the top surface 54 of the boss 50, also indicating an incorrect adjustment of the nut 8.

By applying a wrench to the hexagonal outer surface of the boss 50, the nut 8 may be rotated relative to the stud 4 until the top of the stud is even or flush with the top 54 of the boss 50. Thus, the tool apparatus 40, like the tool apparatus 20, provides for the visual observation of the nut 8 to determine proper adjustment. However, unlike the apparatus 20, the apparatus 40 also is adjustable to provide the proper valve clearance. The tool apparatus thus combines two functions, that of a gauge and of an adjustment tool.

Figure 12:
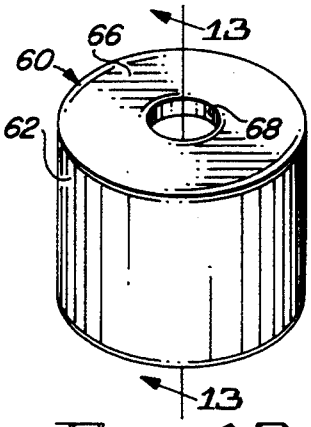
FIG. 12 is a perspective view of another alternate embodiment of the apparatus of the present invention, specifically an alternate embodiment of the apparatus of FIG. 1.
Figure 13:
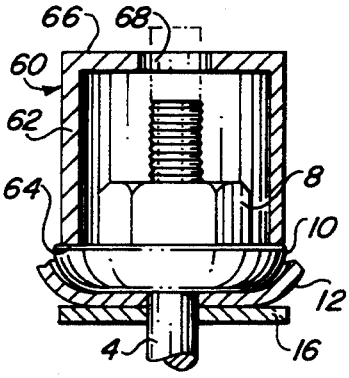
FIG. 13 is a view in partial section taken generally along line 13—13 of FIG. 12 and including a portion of the use environment of the apparatus of FIG. 12.

FIG. 12 is a perspective view of another alternate embodiment of the apparatus of the present invention, namely an indicator apparatus 60. FIG. 13 is a view in partial section taken generally along line 13—13 of FIG. 12, showing the indicator apparatus 60 in its use environment. For the following discussion, reference will be made primarily to FIGS. 12 and 13.

The apparatus 60 is, like the apparatus 20, merely an indicator tool. The apparatus 60 includes a cylindrical element 62 with an open bottom 64 and a closed top wall 66. A clearance hole 68 extends through the top wall 66. The clearance hole 68 is aligned with a longitudinal axis of the cylinder or cylindrical element 62.

In FIG. 13, the bottom 64 is shown disposed on the top of the ball seat or pivot element 10. The top of the stud 4 is disposed beneath the top wall 66. The stud 4 is accordingly incorrectly adjusted. The overall height of the cylindrical element 62, from the bottom face 64 to the surface of the top wall 66 is appropriately calibrated to have a distance equal to the correct adjustment of the stud 4 when the top surface of the stud 4 is flush or even with the top surface of the top wall 66. The clearance hole 68 is, of course, of a diameter to allow observation through the hole to see where the top surface of the stud is and adequate clearance for the stud 4.

The stud 4 is also shown in dash/dot line extending upwardly above the top surface of the top of the wall 66 which also indicates an incorrect adjustment. Again, when the top of the stud 4 is flush with the top surface of the wall 66, the stud is correctly adjusted.

Figure 14:
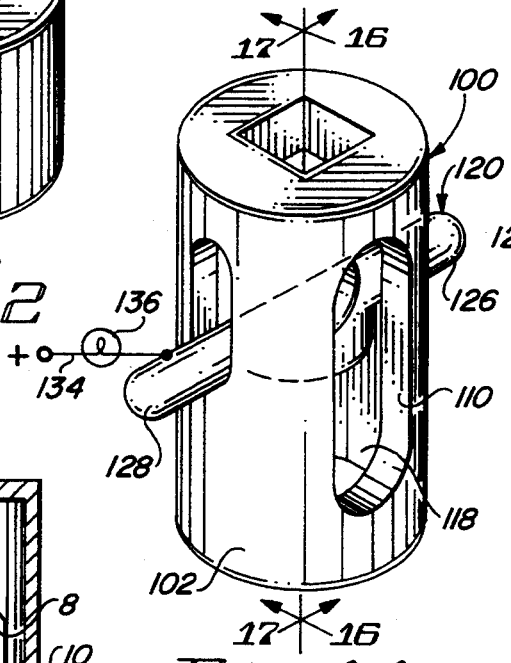
FIG. 14 is a perspective view of another alternate embodiment of the apparatus of the present invention.

FIG. 14 is a perspective view of another alternate embodiment 100 of the apparatus of the present invention. The apparatus 100 again combines the gauging function of the apparatus 20 and the apparatus 60 with the gauging and adjusting capability of the apparatus 40.

The adjusting tool apparatus 100 comprises an alternate embodiment of the apparatus 40 in that it combines both gauging and adjusting capabilities.

Figure 16:
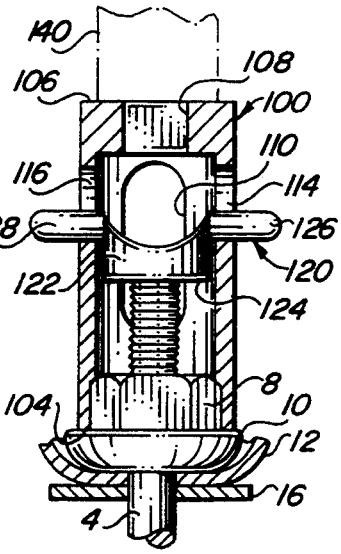
FIG. 16 is a view in partial section taken generally along line 16—16 of FIG. 14 also illustrating the use environment of the apparatus of FIG. 14.
Figure 15:
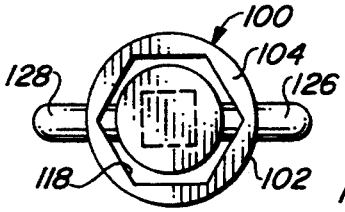
FIG. 15 is a bottom view of the apparatus of FIG. 14.
Figure 17:
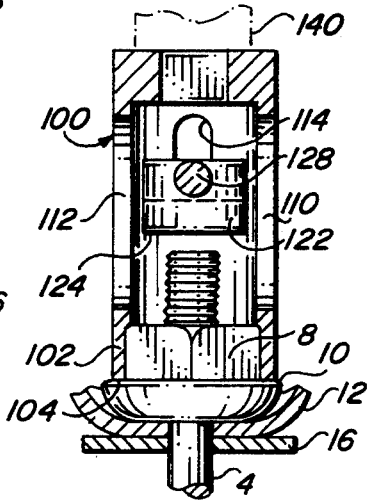
FIG. 17 is a view in partial section taken generally along line 17—17 of FIG. 14 also illustrating the use environment of the apparatus of FIG. 14.
Figure 18:
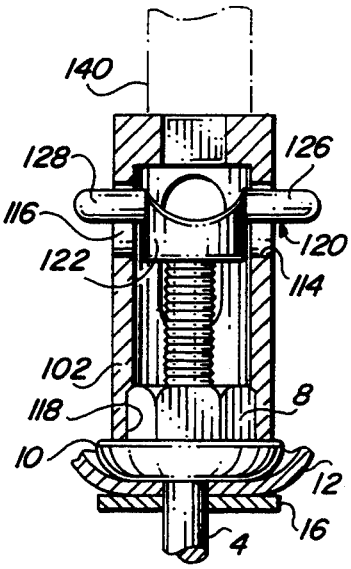
FIG. 18 is a view in partial section illustrating the use environment of the apparatus of FIG. 14.

FIG. 15 is a bottom view of the apparatus 100. FIG. 16 is a side view in partial section of the apparatus 100 taken generally along line 16—16 of FIG. 14 and illustrating the apparatus 100 in its use environment. FIGS. 17 and 18 are similar views in partial section illustrating the tool apparatus 100 in its use environment. In FIG. 17, the tool apparatus 100 is rotated 90 degrees from that shown in FIG. 16. FIG. 18 shows the tool apparatus 100 in the same orientation as shown in FIG. 16. For the following discussion, reference will be made primarily to FIGS. 14, 15, 16, 17, and 18.

The gauging and adjusting tool apparatus 100 includes a cylinder 102. The cylinder 102 includes a bottom surface or face 104. The cylinder 102 is closed by a top wall 106. Extending through the top wall is a square drive hole 108. The square drive hole 108 receives a ratchet wrench tip, as indicated in dotted line in FIGS. 16, 17, and 18.

Extending through the cylinder 102 are two viewing windows, a viewing window 110 and a viewing window 112. The viewing windows are relatively long, or elongated, as may best be understood from FIG. 14.

The viewing windows 110 and 112 are diametrically opposed to each other, as may be understood from FIG. 17. Also extending diametrically through the cylinder 102 are two calibrated slots 114 and 116. The calibrated slots 114 and 116 are disposed substantially 90 degrees from the viewing windows 110 and 112.

Extending upwardly from the bottom surface 104 in the cylinder 102 is a bottom or inside hexagonal portion 118. The hex portion 118, of course, receives a nut 8, as shown in FIGS. 16, 17, and 18.

Disposed within the cylinder 102 and extending between the calibrated slots 114 and 116 is a magnetic position indicator bar 120. The magnetic position indicator bar 120 includes a center portion 122 which is disposed within the cylinder 102 and a pair of arms 126 and 128 which extend outwardly through the calibrated slots 114 and 116, respectively. The center portion 122 includes a generally flat bottom 124. The position indicator bar 120 is calibrated inside, along with the slots 114 and 116, such that when the bottom 124 is disposed on the top of the stud 4, and the arms 126 and 128 are disposed on the bottom of the slots 114 and 116, respectively, as shown in FIG. 16, the stud 4 is appropriately adjusted.

In FIGS. 17 and 18, the stud 4 is shown improperly adjusted. In FIG. 17, the top of the stud 4 is shown spaced apart from the bottom surface 124 of the indicator bar 120. In FIG. 18, the top of the stud 4 is shown lifting the indicator bar 120 above the bottom of the slots 114 and 116. This also is indicative of an improper adjustment of the stud 4.

By observing the relationship of the stud 4 to the indicator bar 120 through either the viewing window 110 and the viewing window 112, and by rotating the apparatus 100 by use of a wrench, such as a socket wrench 140, shown in dash/dot line, and whose square drive extends into the aperture or hole 108, the nut 8 on the stud 4 may be appropriately adjusted through visually observing the relationship of the stud 4 and the indicator bar 120.

The cylinder 102, like the cylinder 22 of the apparatus 20, is preferably non-magnetic to allow for the use of the magnetic position indicator bar 120, just as the cylinder 22 conveniently allows for the utilization of the magnetic indicator bar 32. For use with visual or audible signal elements, the cylinder 102 is either nonconductive or else the bar 120 is electrically insulated from the cylinder 102.

Signal elements are schematically illustrated in FIG. 14. The elements, and their operation, is substantially the same as discussed above in conjunction with FIGS. 1 and 2.

The signal elements include a conductor 134 extending from the bar 120 to the positive terminal of a battery. A lamp 136 is in the conductor 134. When the bottom 124 of the bar 120 contacts the top of the stud 4, the electrical circuit is competed between the battery positive terminal and its ground and the lamp 136 will turn on (or an audible sound will be heard).

Going from the showing of FIG. 17 to the showing of FIG. 16, the turning on of the lamp 136 will indicate the correct adjustment of the nut 8 on the stud 4. Going from the showing of FIG. 18 to the showing of FIG. 16, the turning off of the lamp 36 (or the turning off of an audible signal) will indicate that the correct adjustment has just barely been passed by and a tweaking of the nut may be made to turn on the lamp (or the audible signal).

The visual indications of the improper adjustment of the nut 8 relative to the stud 4 for the apparatus 20 is shown in FIGS. 4 and 5 by the horizontal lines and the arrows. The visual indications of the improper adjustment of the nut 8 relative to the stud 4 for the apparatus 40 is shown by the horizontal lines and the arrows in FIGS. 10 and 11. The visual indication of the improper adjustment of the nut 8 relative to the apparatus 60 is shown by the horizontal lines in FIG. 13.

In each of the noted Figures, the top surface of the top walls or elements is the correct height of the top of the stud 4 relative to the nut 8, and specifically relative to the top surface of the ball seat or pivot 10 against which the nut 8 bears. The ball seat or pivot 10 in turn bears against the rocker arm 12, and it is the adjustment of the rocker arm that is determinative relative to the valve lifter of an engine, as is well known and understood.

It will again be noted that each of the cylinders or cylindrical elements involved in the four embodiments includes a cylindrical element whose overall height or length is calibrated in accordance with a desired length of a stud. Since the height of the valve lifter studs may vary from vehicle to vehicle or from engine to engine, different tool elements will be needed for each of the various engines involved.

Although it may be necessary to produce a number of tools with different dimensional characteristics, each tool may be used on a large number of engines. Most manufacturers use the same valve train adjusting components for the majority of their engines and have standardized this area with the design remaining constant for many years.

THEREFORE, the foregoing is considered as illustrative only of the principles of the invention. Further, since numerous modifications and changes will readily occur to those skilled in the art, it is not desired to limit the invention to exact materials and construction and the operation described, and accordingly, all suitable modifications and equivalents may be resorted to, falling within the scope of the invention.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, within the limits only of the true spirit and scope of the invention.

What we claim is:

1. Hand tool apparatus for visually gauging the correct adjustment of a valve lifter of an engine and for adjusting the valve lifter by adjusting a valve lifter nut on a valve lifter stud comprising in combination:

cylinder means for disposing on the stud and nut, including means for gauging the height of the stud relative to the nut to determine the correct adjustment of the stud;

socket means in the cylinder means for contacting the nut and for rotating the nut in response to rotation of the cylinder means; and means for rotating the cylinder means for adjusting the nut on the stud.

2. The apparatus of claim 1 in which the means for gauging the correct height of the stud relative to the nut includes bar means for contacting the stud.

3. The apparatus of claim 2 in which the bar means includes a magnetic bar.

4. The apparatus of claim 3 in which the bar means includes a central portion for contacting the stud and a pair of arms extending outwardly from the center portion.

5. The apparatus of claim 4 in which the cylinder means further includes window means for viewing the center portion of the bar means relative to the stud.

6. The apparatus of claim 5 in which cylinder means further includes slots for receiving the arms of the bar means for supporting the bar means.

7. The apparatus of claim 3 in which the cylinder means further includes slot means for receiving and supporting the bar means.

8. The apparatus of claim 7 in which the slot means includes a pair of slots calibrated with respect to the height of the stud when the stud is correctly adjusted.

9. The apparatus of claim 1 in which the means for gauging the height of the stud relative to the nut includes a top wall on the cylinder means and an aperture in the top wall for receiving the stud, and the height of the top wall is calibrated to the correct height of the stud.

10. The apparatus of claim 9 in which the means for rotating the cylinder means includes a boss disposed about the aperture in the top wall and flats on the boss for receiving a wrench to rotate the cylinder means.

11. Gauge apparatus for gauging the adjustment of a hydraulic valve lifter nut on valve lifter stud comprising in combination:

cylinder means disposed about the nut and the stud including means for rotating the nut relative to the stud; and indicator means in the cylinder means for indicating the adjustment of the nut relative to the stud.

12. The apparatus of claim 11 in which the indicator means includes an indicator bar movable in the cylinder means for contacting the stud.

13. The apparatus of claim 12 in which the cylinder means is nonmagnetic and the indicator bar is magnetic.

14. The apparatus of claim 11 in which the cylinder means includes a pair of slots for receiving the indicator bar, and the location of the slots is correlated to the correct adjustment of the nut relative to the stud.

15. The apparatus of claim 11 in which the indicator means includes a top wall on the cylinder means and an aperture extending through the top wall for receiving the stud.

16. The apparatus of claim 15 in which the cylinder means includes a cylinder having a height correlated to the correct adjustment of the nut, and the top wall is at the correlated height.

17. The apparatus of claim 11 which further includes means for rotating the cylinder means for rotating the nut.

* * * * *